US005753847A

United States Patent [19]

Middione et al.

[11] Patent Number: 5,753,847

[45] Date of Patent: May 19, 1998

[54] GRILLE ARMOR APPLIQUE'

[75] Inventors: Mark Albert Middione, Scotts Valley; Christopher Michael Tarantino, Livermore; David Arthur Schade, San Carlos, all of Calif.

[73] Assignee: United Defense LP, Arlington, Va.

[21] Appl. No.: 823,430

[22] Filed: Mar. 24, 1997

[51] Int. Cl.[6] ..... F41H 7/04

[52] U.S. Cl. ..... 89/36.08; 89/36.02

[58] Field of Search ..... 89/36.08, 36.13, 89/36.14, 36.07, 36.04, 36.11, 36.02, 36.09; 109/49.5

[56] References Cited

U.S. PATENT DOCUMENTS

| | | | |
|---|---|---|---|
| 2,397,809 | 4/1946 | Roeder et al. | 89/36.13 |
| 3,428,141 | 2/1969 | Forstner et al. | 89/36.08 |
| 3,504,644 | 4/1970 | Schibisch | 109/49.5 |
| 5,117,734 | 6/1992 | Rhoads | 89/1.2 |
| 5,187,316 | 2/1993 | Hasler et al. | 89/36.02 |

FOREIGN PATENT DOCUMENTS

| | | | |
|---|---|---|---|
| 1114410 | 9/1961 | Germany | 89/36.08 |
| 1576781 | 3/1970 | Germany | 89/36.08 |
| 2206754 | 8/1973 | Germany | 89/36.08 |
| 166540 | 3/1981 | Netherlands | 89/36.08 |

*Primary Examiner*—Stephen M. Johnson
*Attorney, Agent, or Firm*—Michael B.K. Lee; Douglas W. Rudy

[57] ABSTRACT

The invention provides a grille armor system for use on a armored vehicle. The grille armor system adds an appliqué grille to a grille to increase the protection provided by the grille armor system. The appliqué grille is designed to add a minimal profile. The appliqué grille also is designed to allow maximum air flow through the appliqué grille. In the preferred embodiment, the appliqué grille is made of 4 mm thick steal bars place 8 mm apart to provide added protection to aluminum S-shaped louvers against high velocity 20 mm fragment simulating projectiles.

16 Claims, 2 Drawing Sheets

GRILLE ARMOR APPLIQUE'

BACKGROUND OF THE INVENTION

The present invention relates generally to grille's used in armored protection.

In the prior art, aluminum S-shaped louvers formed grilles, which were used to provide protection for intake exhaust vents on armored vehicles. Current grilles by themselves do not provide sufficient protection against high velocity artillery threats. The provision of sufficient protection was a balance between the desired protection and the desired air flow.

SUMMARY OF THE INVENTION

It is an object of the invention to provide a method and apparatus, using an appliqué that gives improved ballistic protection for intake and exhaust vents.

It is another object of the invention to provide an appliqué grille that allows sufficient air flow.

The invention places an appliqué over existing grilles. The appliqué is a grille of parallel bars with a thickness and spacing related to the diameter of the threat projectile.

DESCRIPTION OF THE PREFERRED EMBODIMENTS

Figure 1:
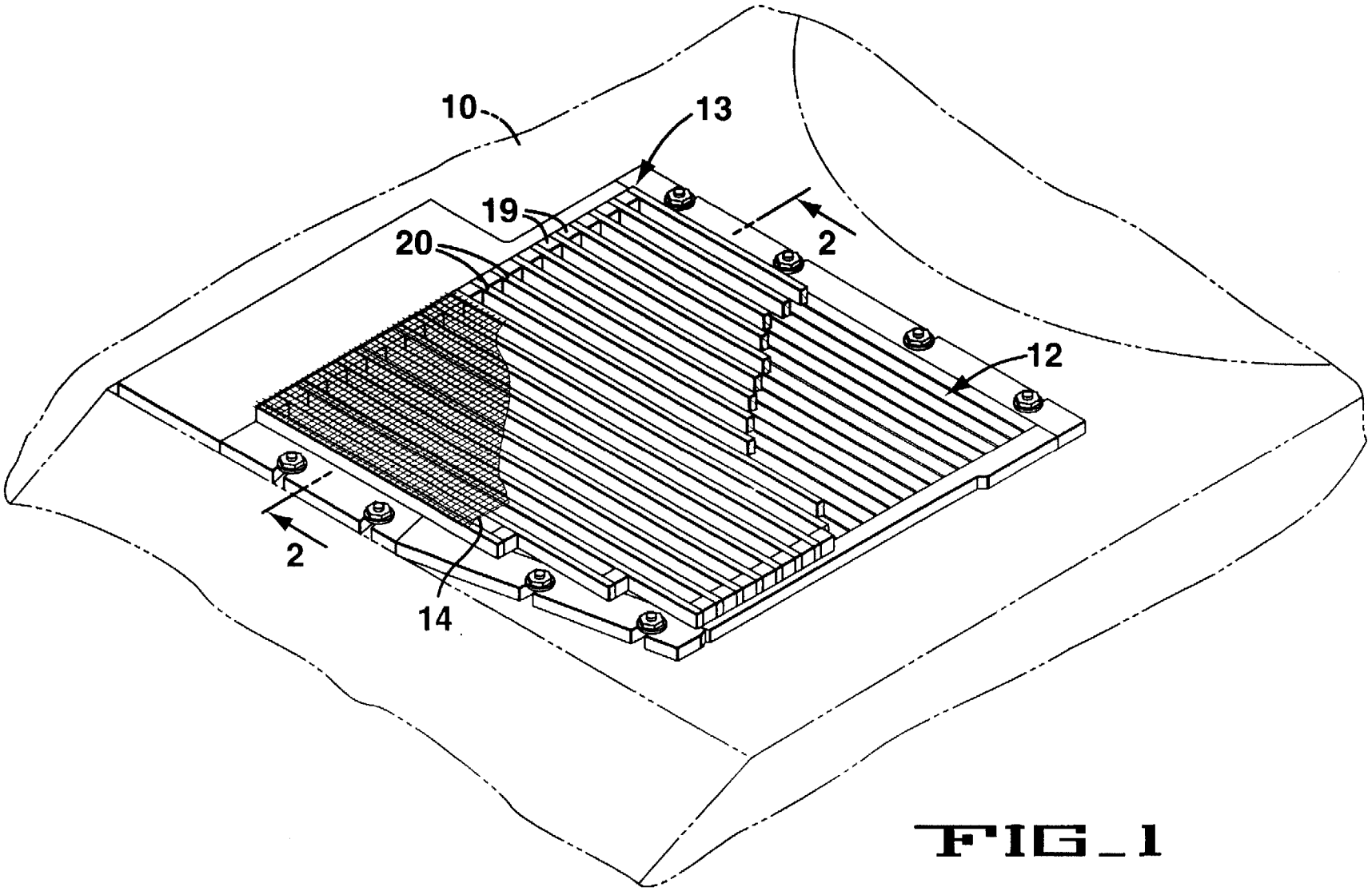
FIG. 1 is a cut away perspective view of a preferred embodiment of the invention mounted on the hull of a vehicle.

In FIG. 1 the hull of an armored vehicle 10 uses an grille 12 as a protective grille for engine cooling air. An appliqué grille 13 is placed over the grille 12 to provide increased protection while maintaining air flow through the grille 12 at acceptable levels. A screen 14 is placed on top of the appliqué grille 13 to prevent the ingestion of debris.

Figure 2:
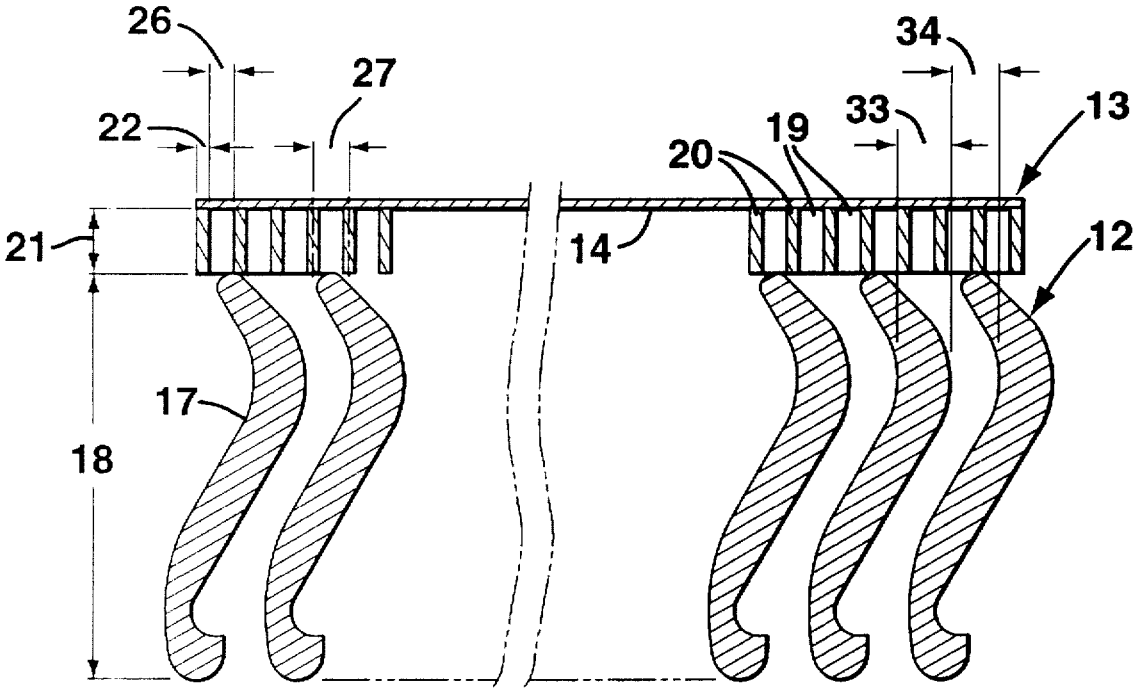
FIG. 2 is a cross sectional view of the embodiment illustrated in FIG. 1 along line 2—2.

FIG. 2 is a cross sectional view of the grille 12, appliqué grille 13, and the screen 14. In the preferred embodiment, the screen is a wire fabric made of low carbon galvanized steel wire. The wire has a 0.035 inch (0.889 mm) diameter and forms a 7×7 mesh, which has 7 squares by seven squares per square inch. In the preferred embodiment, the grille 12 is formed by a plurality of parallel S-shaped louvers 17. The S-shaped louvers 17 are aluminum. The S-shaped louvers 17 have various lengths determined by the shape of the grille 12. The S-shaped louvers 17 have a width 18 of 5 inches (127 mm). The S-shaped louvers overlap, defined in that when S-shaped louvers overlap there is no straight path in the direction of the widths of a S-shaped louver and within the grille that does not encounter an S-shaped louver. The S-shaped louvers 17 are spaced apart center to center 1.250 inches (31.75 mm). The louvers have a thickness 33 of 0.625 inches (15.875 mm). They are spaced with a spacing 34 of 0.625 inches apart (15.875 mm).

The appliqué grille 13 is formed by a plurality of metal bars 20. The metal bars 20 are straight and parallel to each other. The metal bars 20 are also parallel to the S-shaped louvers 17. The metal bars 20 have various lengths determined by the shape of the appliqué grill 13. In the preferred embodiment, the metal bars 20 are made of Armox steel.

Preferably, the metal bars 20 are made of a steel with a Brinell Hardness between 500 and 600. The metal bars 20 have a width 21 of 0.984 inches (25 mm). The metal bars 20 have a thickness 22 of 0.157 inches (4 mm). The spacing 26 between the sides of the metal bars 20 is 0.315 inches (8 mm), so that the center to center distance 27 is 0.472 inches (12 mm). In this embodiment, the metal bars 20 have a rectangular cross section. Spacers 19 are welded between the metal bars 20 to provide the 8 mm spacing between the metal bars 20 and to form a frame around the metal bars 20.

The grille 12 has a first side and a second side forming the largest surface areas of the grille 12. The appliqué grille 13 is placed on the first side of the grille 12. The screen 14 is place on top of the appliqué grille 13.

The space to thickness ratio of the appliqué grille 13 is the ratio of the spacing 26 between the metal bars 20 to the thickness 22 of the metal bars 20, which would be 8 mm to 4 mm or 2:1. This is greater than the ratio of the spacing between the S-shaped louvers 34 and the thickness of the S-shaped louvers 33, which would be 0.625 inches to 0.625 inches or 1:1. Therefore the appliqué grille 13 has a 33% greater air space than the S-shaped louver grille 12. This is so that appliqué grille 13 allows more air flow than the grille 12.

Figure 3:
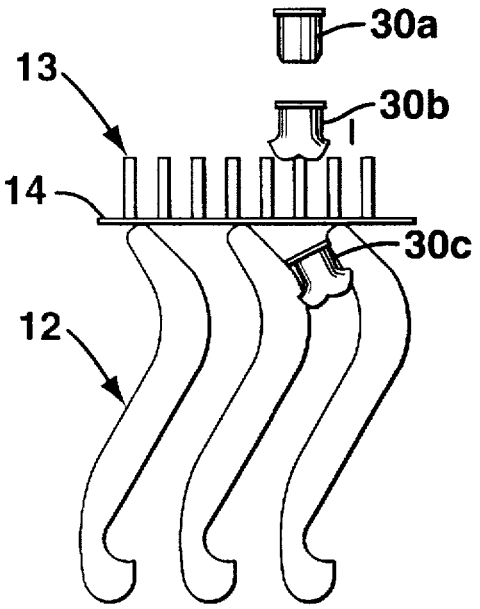
FIG. 3 is a schematic illustration of the embodiment shown in FIG. 1.

FIG. 3 is a schematic illustration of how the invention is able to stop a high velocity 20 mm fragment simulating projectile. Before the projectile 30*a* encounters the grille system, the projectile may be right circular cylinder with two small chamfers on the front. The projectile 30*b* encounters at least one of the metal bars 20. The projectile 30*b* breaks through the metal bars 20, but the metal bars 20 cause the projectile 30*b* to spread to more of a mushroom shape. The spread mushroom shape projectile 30*c* is more easily stopped by the aluminum S-shaped louvers 17. The appliqué may also break-up the projectile, taking energy from a single mass and spreading the energy into multiple masses, which are stopped by the aluminum S-shaped louvers 17.

Smaller projectiles may be stopped by the grille alone and the appliqué grille 13 enhances the defeat of large high velocity fragments.

In other embodiments, the edge of the metal bars furthest from the grille are curved to provide an increased aerodynamic shape.

In the prior art, aluminum S-shaped louvers were used to form grilles for engine air intake and exhaust vents on the Bradley Fighting Vehicle. Such grilles were able to stop projectile threats up to medium velocity 20 mm fragment simulating projectiles, but were unable to stop high velocity 20 mm projectiles. The addition of the appliqué grille, provides an armor grille system that is able to stop high velocity 20 mm projectiles. The appliqué grille does not harm the air flow through the grille system to provide engine cooling by providing an airflow area 33% greater than the grille below. The appliqué grill has a low profile so that it does not interfere with the use of the Bradley Fighting Vehicle. The center to center spacing of the metal bars in the preferred embodiment is approximately half the diameter of the maximum threat, which the grille appliqué is to protect from. In other embodiments, the center to center spacing of the metal bars may be between one quarter to three quarters of the diameter of the maximum threat, which the grille appliqué is to protect from. The spacing between the metal bars are designed to be close enough to achieve multiple intercepts between the projectile and the appliqué grille. The ratio of the thickness of the metal bars to the spacing is in the range between one to four and three to four.

In other embodiments, the appliqué grille may provide an air flow more than 33% greater than the grille. In another embodiment the length of the metal bars may be perpendicular to the length of the S-shaped louvers. In another embodiment, the louvers may be flat and slanted. Another embodiment uses metal bars made of other high strength metals such as tungsten or titanium.

While preferred embodiment of the present invention has been shown and described herein, it will be appreciated that various changes and modifications may be made therein without departing from the spirit of the invention as defined by the scope of the appended claims.

What is claimed is:

1. An armor grille system, comprising:

an armor hull with an aperture;

a grille of louvers extending across the aperture of the hull, wherein the grille has a first side and a second side, wherein the first side of the grille is outside of the hull;

an appliqué grille extending across the aperture along the first side of the grille, wherein the appliqué grille comprises a plurality of metal bars, which have a thickness and a spacing, wherein the grille louvers have a length, and wherein the grille louvers have a thickness and are spaced apart by a first spacing, and wherein the metal bars have a length, and wherein the metal bars have a thickness and are spaced apart by a second spacing, wherein the ratio of the thickness of the grille louvers to the first spacing is greater than the ratio of the thickness of the metal bars to the second spacing.

2. The armor grill system, as claimed in claim 1, wherein the grille louvers are parallel and wherein the metal bars are parallel to the grille louvers.

3. The armor grille system, as claimed in claim 2, wherein the grille louvers have an S-shaped cross section.

4. The armor grille system, as claimed in claim 3, wherein the grille louvers are made of aluminum.

5. The armor grille system, as claimed in claim 4, wherein the metal bars are made of a metal with a Brinell Hardenss greater than 500.

6. The armor grille system, as claimed in claim 5, wherein ratio of the thickness of the metal bars to the spacing is in the range between one to four and three to four.

7. The armor grille system, as claimed in claim 6, wherein the ratio of the thickness of the metal bars to the spacing is one to two.

8. The armor grille system, as claimed in claim 7, wherein the metal bars are 4 mm thick and spaced 8 mm apart.

9. The armor grille system, as claimed in claim 7, wherein center to center distances between the metal bars are substantially equal to have of a diameter of a maximum threat projectile for which the armor grille system was designed to defeat.

10. The armor grille system, as claimed in claim 9, further comprising a screen on top of the appliqué grille.

11. An armor grille system, comprising:

an armor hull with an aperture;

a grille of louvers extending across the aperture of the hull, wherein the grille has a first side and a second side, wherein the first side of the grille is outside of the hull;

an appliqué grille extending across the aperture along the first side of the grille, wherein the appliqué grille comprises a plurality of metal bars, which have a thickness and a spacing, wherein the grille louvers have a length wherein the grille louvers are parallel, and wherein the grille louvers have a thickness and are spaced apart by a first spacing, and wherein the metal bars have a length, wherein the metal bars are parallel to the grille louvers, and wherein the metal bars have a thickness and are spaced apart by a second spacing; and a screen on top of the appliqué grille.

12. The armor grille system, as claimed in claim 1, wherein the ratio of the thickness of the grille louvers to the first spacing is greater than the ratio of the thickness of the metal bars to the second spacing.

13. The armor grille system, as claimed in claim 12, wherein the grille louvers have an S-shaped cross section.

14. The armor grille system, as claimed in claim 13, wherein the grille louvers are made of aluminum.

15. The armor grille system, as claimed in claim 14, wherein the metal bars are made of steel.

16. The armor grille system, as claimed in claim 15, wherein the ratio of the thickness of the metal bars to the spacing is in the range between one to four and three to four.

* * * * *